United States Patent [19]

Pittman

[11] Patent Number: 4,793,593

[45] Date of Patent: Dec. 27, 1988

[54] JACK SYSTEM FOR LIFTING ROOF MOUNTED AIR CONDITIONERS

[76] Inventor: Don Pittman, 801 S. Flower St., Burbank, Calif. 91502

[21] Appl. No.: 150,514

[22] Filed: Feb. 8, 1988

Related U.S. Application Data

[63] Continuation of Ser. No. 863,097, May 14, 1986, abandoned.

[51] Int. Cl.[4] ..... B66F 7/12

[52] U.S. Cl. ..... 254/89 H

[58] Field of Search ..... 254/89 R, 89 H, 90, 254/91, 92, 45

[56] References Cited

U.S. PATENT DOCUMENTS

| | | | |
|---|---|---|---|
| 282,436 | 7/1883 | Bowser | 254/92 |
| 515,620 | 2/1894 | Schmidt et al. | 254/92 X |
| 4,491,452 | 1/1985 | Matovich | 254/89 R X |

FOREIGN PATENT DOCUMENTS

| | | | |
|---|---|---|---|
| 3244318 | 8/1983 | Fed. Rep. of Germany | 254/90 |
| 749722 | 7/1980 | U.S.S.R. | 254/92 |

*Primary Examiner*—Frederick R. Schmidt
*Assistant Examiner*—Judy J. Hartman
*Attorney, Agent, or Firm*—Beehler, Pavitt, Siegemund, Jagger, Martella & Dawes

[57] ABSTRACT

A load lifting device for temporarily lifting and supporting roof mounted equipment such as air conditioning units so that roof repairs may be made includes spaced beam sections insertable under the roof mounted equipment and jacks for raising such equipment off the roof. Each beam section includes an outer end which is raised relative to the portion inserted under the equipment, the jacks being received under the raised ends. The beam sections include stops which are positioned adjacent the equipment to keep the jacks spaced laterally of the equipment. After the repairs, the roof mounted equipment is lowered into place.

8 Claims, 1 Drawing Sheet

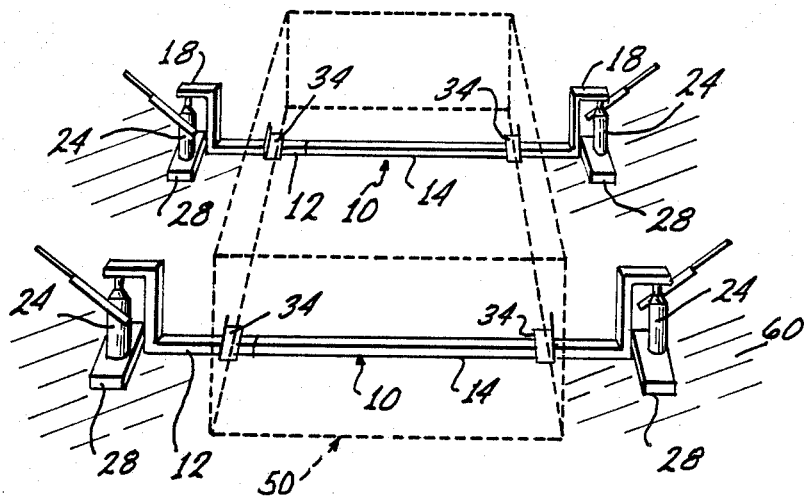
Fig. 1
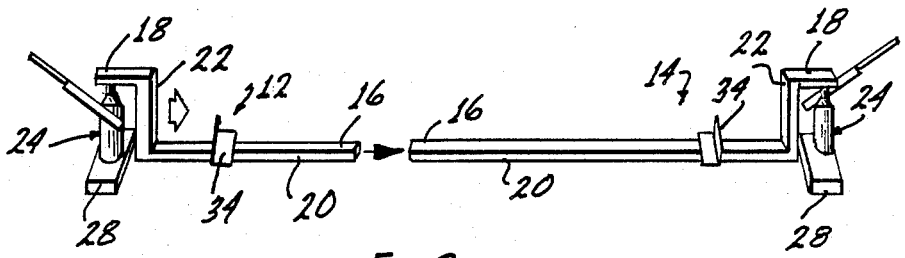
Fig. 2
Fig. 3
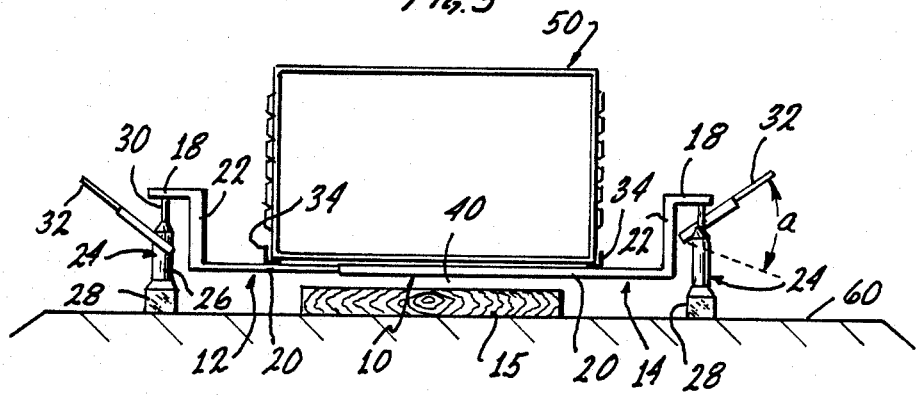

JACK SYSTEM FOR LIFTING ROOF MOUNTED AIR CONDITIONERS

This is a continuation of co-pending application Ser. No. 06/863,097 filed May 14, 1986, now abandoned.

BACKGROUND OF THE INVENTION

1. Field of the Invention

The present invention pertains generally to the field of load lifting devices and is more particularly directed to a jack system suitable for lifting and temporarily supporting roof mounted air conditioning equipment away from the roof surface so as to permit access for repair of the underlying roof area.

2. State of the Prior Art

It is common practice in the construction industry to mount the heat exchanger units of central air conditioning systems on the roof of the building where ambient air is blown through the unit for cooling purposes. The usual installation consists of simply resting the air conditioning unit on a pair of wooden blocks, called runners, or similar spacers placed on the roof surface. Such arrangements are particularly common in buildings having flat, level roofs. This type of roof is typically weather-proofed by one or more layers of tar paper and asphalt, or equivalent impermeable sheet material, which in time develops cracks and open seams along overlapping edges of the roofing material so that rain water leaks through the roof, therefore requiring periodic maintenance and repair. Eventually, as the roofing material ages, localized patching and minor repairs no longer suffice to maintain the integrity of the roof and complete re-roofing becomes necessary. Re-roofing involves the laying down of fresh tar paper or the like over the old roofing material and waterproofing all joints and seams with hot, liquid asphalt. Roofing material such as tar paper is bought in rolls which are unrolled on the roof surface as relatively long parallel strips of roof covering until the desired area has been covered. Irregular portions of the roof are then individually treated with pieces of roofing material cut and laid down as required.

A recurring problem in re-roofing jobs is the presence of roof mounted air conditioning equipment arranged on the roof without regard for the eventual need to gain access under those units for roof maintenance and repair.

The air conditioning units are usually not fastened down to the roof and merely rest on spacers or supports high enough to keep the unit above rain puddles and out of contact with the tar and asphalt roof covering, leaving very little clearance between the air conditioning unit and the roof surface for purposes of roof repair. The clearance under the air conditioning unit is typically three and a half inches due to the common use of 4×4 wooden runners as supports for this purpose. In order to obtain adequate access to the roof area under such air conditioning units, it is desirable to raise the unit by at least an additional four to five inches so that it is supported at least 8–9 inches above the roof surface while the wooden supports are pulled out and new roofing material laid under the raised unit.

The present approach is to lift the air conditioning equipment, often weighing hundreds of pounds, with makeshift levers made of 2×4 timer or with crowbars which frequently damage the air conditioning unit or the associated sheet metal duct work and electrical conduits. No convenient, low cost, work saving system is known for dealing with this problem and a continuing need exists for a simple, safe and effective device for quickly and easily lifting and supporting roof mounted air conditioning units or other roof mounted equipment while repair or re-roofing work is carried out under the raised unit.

SUMMARY OF THE INVENTION

The present invention offers a solution to the aforementioned difficulties by disclosing a jack system and a method for raising and supporting a load above an underlying surface particularly in situations where there is limited clearance between the load and the supporting surface, as in the typical roof mounted air conditioning unit.

The novel jack system consists of at least one load bearing beam, but the typical jack system according to this invention will make use of two such beams. Each beam is made up by joining two support elements or beam sections inserted under the air conditioning unit from opposite sides of the unit. The two beams sections are joined together and assembled underneath the air conditioning unit to make a substantially rigid beam extending the full width of the air conditioning unit. The overall length of the beam exceeds the width of the air conditioning unit along the direction of the beam such that the ends of the beam protrude from opposite sides of the air conditioning unit. Lifting force is then applied to the protruding beam ends to thereby raise the unit on one or more such beams away from an underlying roof surface. It is presently preferred to apply the lifting force by means of portable, self-contained hydraulic jack units interposed between each protruding beam end and the underlying roof surface.

The first and second sections making up a beam each have an inner end and an outer end. The inner ends are mutually engageable as by telescopic sliding engagement one into the other so as to make up a substantially rigid beam of adjustable overall length. The outer end of each beam section is supported on a jack unit so that the assembled beam is supported only at its two ends, thereby providing a clear working space under the raised unit. The jack units are operated independently but in a coordinated manner so as to try and maintain the beam substantially level above the roof surface as the load is being raised.

In a preferred embodiment of the invention, the beam sections are shaped or bent such that their outer ends are elevated above the roof surface to a height sufficient for admitting a jack unit between each outer end and the roof surface, while maintaining the inner portions of the two sections flush with or very close above the roof surface so that they can be inserted under an air conditioning unit and joined into a beam. In other words, the inner end of the beam section must slide into the small clearance space under the load while the outer end of the section is supported on the jack unit. For example, each beam section may be made up of three lengths of square steel tubing welded together: a relatively long straight tube segmeent which constitutes the inner portion including the inner end of the beam segment; a shorter vertical tube segment rising from the outer end of the inner segment, and another short horizontal tube segment supported at the top end of the vertical riser segment parallel to the long inner segment but extending in the opposite direction, i.e. away from the inner end. The two short segments thus form an inverted L welded to the long straight inner tube segment. A jack unit may be placed between the horizontal upper leg of the inverted L and the roof surface at each end of an assembled beam. As a safety measure, it is preferable to permanently affix, as by welding, each jack unit to the outer end of a corresponding beam section so as to avoid the possibility of the beam ends slipping off of the jack unit while the loading is being raised.

It is desirable to provide stop elements on each beam section which limit the degree of insertion of each beam section under the air conditioning unit by abutting against the sides of the unit when the two beam sections are joined underneath the same. The stop elements maintain all jack units evenly spaced away from the sides of the air conditioning unit so as to provide free working space around the raised unit and allow an oversize blanket of roofing material to be laid down extending some distance outwardly from and around the sides of the unit. Thus, when the unit is brought down again on the roof, the oversize blanket forms a border around the unit which border can then be tied into by means of a water proof joint with roofing material covering the rest of the roof. The stop elements are also useful for holding the air conditioning unit against possible sliding movement along the beams in the event that a beam is tilted during jacking.

The typical air conditioning unit will be supported, in the usual case, on four self-contained, portable jacks holding up the four ends of two beams while roofing work is performed under the raised air conditioning unit. Once the work is completed, the wooden runners are replaced under the raised air conditioning unit and the four jacks are lowered, again in a coordinated manner so as to maintain the load substantially level, until the air conditioning unit is lowered to a resting position on the wooden supports. The beams of the jack system are then disassembled by separating the sections comprising each beam and withdrawing the separate sections from opposite sides of the air conditioning unit.

These and other advantates of the present invention will be better appreciated by reference to the detailed description of the preferred embodiment in light of the accompanying drawings.

BRIEF DESCRIPTION OF THE DRAWINGS

FIG. 1 is a perspective view of a complete two beam jack system constructed according to the present invention and assembled under a typical air conditioning unit shown in dotted lining.

FIG. 2 is a perspective view showing a single beam separated into its two component beam sections.

FIG. 3 is an end view of the arrangement of FIG. 2 showing the air conditioning unit raised on the jack system away from a roof surface.

DETAILED DESCRIPTION OF THE PREFERRED EMBODIMENT

With reference to the drawings, FIG. 1 shows a complete jacking system consisting of two separate beams 10, each beam consisting of a first beam section 12 and a second beam section 14 joined by slideable telescoping engagement of the inner ends of the two sections one within the other, as better seen in the exploded view of FIG. 2. The two beam sections 12 and 14 are made of rigid hollow metallic tubing of rectangular cross-section. Each beam section has a relatively long and straight inner portion 20 terminating in an inner end 16, a riser segment 22 rising at a right angle to the portion 20 from the opposite end of the portion 20, and an outer segment 18 parallel to the segment 20 connected at the upper end of the riser 22 but extending in an outward direction, away from the inner end of the segment 20. The segment 22 and 18 thus form an inverted L connected to the inner end of the long segment 20. The two sections 12 and 14 are similar in construction, the difference between the two beam sections being that the inner segment 20 of one of them, i.e. section 14 in the drawings, is longer than that of the other beam section 12, and the tubing of section 14 has an internal cross-section larger than the outer cross-sectional measurement of section 12 so as to allow the inner end 16 of section 12 to slide in telescoping fashion into the hollow inner end 16 of section 14, as indicated in FIG. 2. The inner ends of the two beam sections should fit together snugly without excessive wobbling or looseness between them in order to make a substantially rigid and strong beam unit 10. The length of the two beam sections 12 and 14 should be sufficient so that a substantial part of the inner end portion of the section 12 may be inserted into the mating section 14 so as to ensure substantial rigidity of the assembled being unit.

When the two sections 12, 14 are assembled into a beam 10 the outer portions of the beam each have an inverted L-shape formed by a rising segment 22 and a horizontal outer end segment 18. The outer end segment 18 of each beam section 12, 14 is supported on a self-contained portable hydraulic hand jack unit 24 of conventional design and of a type which is readily commercially available in a range of lifting capacities at relatively low cost. As indicated in FIG. 3, each hydraulic jack unit 24 has a jack body 26 which is supported on and preferably securely screwed to a 2x4 wooden base block 28 in order to increase the effective height of the jack 24 and to stabilize the jacks on the roof surface so as to keep the beam 10 from tilting and falling sideways. Extending from the upper end of the jack body is a rod 30 which is internally connected to a hydraulic piston within the jack body 26 so that rod 30 is driven upwardly by hydraulic pressure built up by manually pumping the jack operating handle 32 as suggested by arrow "a" in FIG. 3. The construction and operation of the jacks 24 is genreally known to persons familiar with such equipment and given the ready commercial availability of suitable hydraulic jack units, further description of the same here is not necessary for understanding the present invention.

The rod 30 can be lowered from an upwardly extended position back down into the jack body 26 by opening a release valve on the jack unit. The upper end of the rod 30 in each jack 24 is welded to the underside of the outer end segment 18 of a beam section such that the jack is permanently affixed to a corresponding beam section 12 or 14, thereby preventing the ends of the beam 10 from slipping off of the jacks 24 while a load is being lifted on the beam 10.

Each of the beam sections 12 and 14 is provided with a stop plate 34 consisting of a short length of angle iron or sheet metal plate bent to a right angle and welded to the inner portion 20 of each beam section at a uniform distance e.g. 6 inches from the riser 22. The stop plates abut against the lower side edges on each side of the air conditioning unit so as to limit the telescopic penetration of section 12 into section 14, thus maintaining the jacks 24 at opposite ends of each beam 10 equidistantly spaced from the air conditioning unit 50, e.g. by 8 inches on each side, so as to permit laying down of the new roofing material outward beyond the sides of the air conditioning unit while the unit is supported on the jack system as in FIG. 3. The stop plates 34 also serve to hold the air conditioning unit 50 against sliding along the beams 10 in the event that the beams should become inclined during the jacking operation.

The assembly and use of the novel jack system will now be described. A typical roof mounted air conditioning unit 50 may be safely and easily lifted from its supporting runners 15 and raised on two beams 10, each consisting of two telescopically joined sections 12 and 14 as already described. Each of the two beams 10 is assembled by inserting the sections 12, 14 for each beam from opposite sides e.g. left and right sides of the air conditioning unit 50 as seen in FIG. 1, and telescopically mating the inner ends 16 of the two sections in the clearance space 40 shown in FIG. 3 between the air conditioning unit 50 and the roof surface 60. The inner ends of the beam sections are then slid one into the other until the stop plate 34 on each section 12 and 14 abuts against the corresponding side of the unit 50, at which point the assembled beam 10 will be supported at its opposite outer ends 18 on two jacks 24 resting on the roof surface 60, and the unit 50 will be positioned above the joined inner tube segments 20. Two such beams 10 are assembled in mutually spaced parallel relationship under the air conditioning unit 50 as shown in FIG. 1, and the two pairs of hydraulic hand jacks 24 are then operated in a coordinated manner, such that the four ends 18 of the two beams 10 are raised at a substantially even rate and both beams 10 carrying the load 50 are maintained as level as possible with roof surface 60.

Each hydraulic jack unit 24 of the type contemplated herein will typically extend from a minimum retracted height of 7.5 inches to a maximum extended height of 12.25 inches. However, because of the particular L shape of the outer ends of the beam sections, the inner tube portions 20 on which the load actually rests are either on or very low over and parallel to the roof surface when the jacks 24 are fully retracted, so as to allow the portions 20 to be slid under a load having very little under-clearance. As little as 1½ inch clearance is needed between the air conditioning unit 50 and roof surface 60 to admit the inner ends 16 of the beam sections, provided of course that the beam sections are constructed of square tubing of less than 1½ inch width. On occasion it will be found that an air conditioning unit to be lifted is supported higher off the roof surface, in which case the jacks will not reach up to a sufficient height. This obstacle is readily overcome by placing additional pads or wooden blocks under each jack 24 to increase the maximum reach of the jacks. This approach may be adopted also if a load must be raised to a height greater than the normal reach of the jacks, keeping in mind that Raising the jacks higher off the roof will also increase the minimum height of the tubing segments 20 over the roof surface 60 and thus require additional existing clearance 40 under the air conditioning unit.

From the foregoing description, it will be appreciated that disclosed herein is a simple, low cost jack system which can be easily and safely operated with a minimum of skill and training. A two-beam jack system disassembles into four separate sections which can be easily carried up to a roof area even by a single individual and do not occupy excessive space in storage or transport.

While a particular embodiment of the invention has been shown and illustrated, it will be understood that various changes, substitutions and modifications to the described embodiment can be made by those possessed of ordinary skill in the art without departing from spirit and scope of the present invention. For example, a jack system according to this invention may comprise more than two beams, if a greater number is desirable for raising a particular load. A single beam jack system consisting of two beam sections 12, 14 is also contemplated where the nature, dimensions and weight of the load are suitable for lifting on a single beam. For example, the beam 10 and particularly the inner portions 20, may be widened so that a load may be balanced on a single beam 10. It will be further understood that the jack system disclosed herein is not limited to use with roof mounted air conditioning units but may be found equally useful for raising loads of any nature provided that the inner ends of two beam sections can be inserted from opposite sides and joined underneath the load. The scope of the invention is therefore defined only by the following claims:

What is claimed is:

1. A method for facilitating re-roofing of an essentially flat roof of buildings having a structure such as an air conditioning unit or other equipment supported in spaced relation to surface of said roof to be repaired by support means resting on the roof, comprising the steps of:

providing at least two pairs of support elements, each of the support elements including a beam section adapted to extend transversely of the structure and to engage the underside thereof for support of the same in spaced relation to the surface of said roof and including a jack receiving end portion including a riser segment and an associated outer segment under which a jack may be placed such that the beam section is below the outer segment, inserting the support elements of each pair under the structure such that the riser section is spaced laterally of the structure, assembling the two support elements of each said pair underneath the structure so as to make at least two substantially rigid load bearing beams extending in mutually spaced apart relationship under the structure and across the full width thereof, said step of assembling including positioning each beam such that each jack receiving end portion is spaced laterally and outwardly from the structure, interposing a jack and supporting a jack beneath each jack receiving end portion of each said beam, applying lifting force by means of said jacks to the jack receiving end portions of said beam to raise said structure off said support means therefor, removing said support means from beneath said structure to fully expose the roof portion beneath said structure and to provide an exposed peripheral portion and thereby permit access for repair of the roof surface under the raised structure and peripherally thereof, and repairing the roof and thereafter positioning the support means under said structure and lowering said structure on to said support means.

2. The method as set forth in claim 1 wherein the step of assembling includes the step of positioning said two support elements such that the beams thereof are in essentially spaced parallel relationship.

3. The method as set forth in claim 1 wherein each of said support elements is comprised of two telescoping beam sections each of a cross-section less than the space between the roof and the underside of said structure, and said step of inserting including inserting the beam sections from opposite sides of said structure and in telescoping relationship to form said load bearing beams.

4. The method as set forth in claim 1 wherein said step of assembling includes positioning said beams such that the outer segment of said jack receiving portion is positioned above the bottom of said structure.

5. The method as set forth in claim 3 wherein each telescoping section includes a stop plate and wherein the step of inserting includes inserting the beam sections such that each stop plate contacts the side and lower surface of said structure.

6. An apparatus for lifting and supporting roof mounted equipment which is supported in spaced relation to said roof to provide a space therebetween and a peripheral clearance around such equipment while re-roofing work is done on the roof surface under and around the raised equipment comprising:

two load bearing beams each consisting of a first and a second beam section each having an inner end and and outer end, said inner ends being mutually telescopically engageable for assembling said sections into a substantially rigid beam of adjustable overall length and capable of supporting said equipment between said outer ends;

a jack supporting structure affixed to the outer end of each beam section;

said jack supporting structure including a riser segment connected at a right angle to said opposite end and a relatively short outer end segment supported by said riser segment in spaced parallel relationship to the associated beam section, a plurality of jacks adapted to be placed under the outer segment of said jack supporting structure, and stop elements on each of said beam sections arranged to abut against the sides of the roof mounted equipment supported on the assembled beams so as to maintain said riser sections and said jacks spaced laterally from the roof mounted equipment whereby repairs can be made to a roof area surrounding the roof mounted equipment and thus leave a border of repaired roofing after the unit is lowered in place.

7. An apparatus as set forth in claim 6 wherein said riser segment of each jack supporting structure is long enough to support the outer end segment at a height sufficient to position one of said jacks thereunder whereby said jacks are positioned laterally of said roof mounted equipment and while said jacks are positioned laterally thereof to permit re-roofing under and peripherally of said roof mounted equipment.

8. An apparatus as set forth in claim 6 wherein each of said beam sections is a straightlength of rigid metallic tubing and said jack supporting structure being welded to each said beam section.

* * * * *